United States Patent [19]

Hensler

[11] Patent Number: 4,864,745

[45] **Date of Patent: * Sep. 12, 1989**

[54] SKIING BOOT

[75] Inventor: Adolf Hensler, Koflach, Austria

[73] Assignee: Koflach Sport Gesellschaft m.b.H & Co. K.G., Vocklabruck, Austria

[ * ] Notice: The portion of the term of this patent subsequent to Sep. 12, 2005 has been disclaimed.

[21] Appl. No.: 761,526

[22] Filed: Aug. 1, 1985

[30] Foreign Application Priority Data

Aug. 1, 1984 [AT] Austria ..... 2480/84

[51] Int. Cl.[4] ..... A43B 5/04

[52] U.S. Cl. ..... 36/120; 36/121

[58] Field of Search ..... 36/117–121

[56] References Cited

U.S. PATENT DOCUMENTS

| | | | |
|---|---|---|---|
| 3,832,792 | 9/1974 | Kastinger | 36/117 |
| 4,095,356 | 6/1978 | Robran et al. | 36/121 |
| 4,186,501 | 2/1980 | Salomon | 36/121 |
| 4,282,658 | 8/1981 | Hanson et al. | 36/121 |
| 4,381,613 | 5/1983 | Lederer | 36/121 |
| 4,455,768 | 6/1984 | Salomon | 36/121 |
| 4,577,420 | 3/1986 | Petrini et al. | 36/117 |
| 4,665,635 | 5/1987 | Benoit et al. | 36/120 |
| 4,694,593 | 9/1987 | Petrini et al. | 36/120 |

FOREIGN PATENT DOCUMENTS

| | | | |
|---|---|---|---|
| 8514965 | 8/1985 | Fed. Rep. of Germany . | |
| 2480575 | 10/1981 | France . | |
| 2539278 | 7/1984 | France . | |
| 2555418 | 5/1985 | France | 36/117 |

*Primary Examiner*—James Kee Chi

[57] ABSTRACT

The skiing boot (1) comprises a shell (2) and a leg part (3), which is pivotally moveable relative to the shell. The lower end portion (5) facing the toe of the boot is formed with a groove (7) for accommodating elements (6) having rubberlike elasticity. When the lower end portion (5) of the leg part has run up on or engaged the shell, the element (6) having rubberlike elasticity will be compressed as the pivotal movement toward the forward lean position is continued.

7 Claims, 3 Drawing Sheets

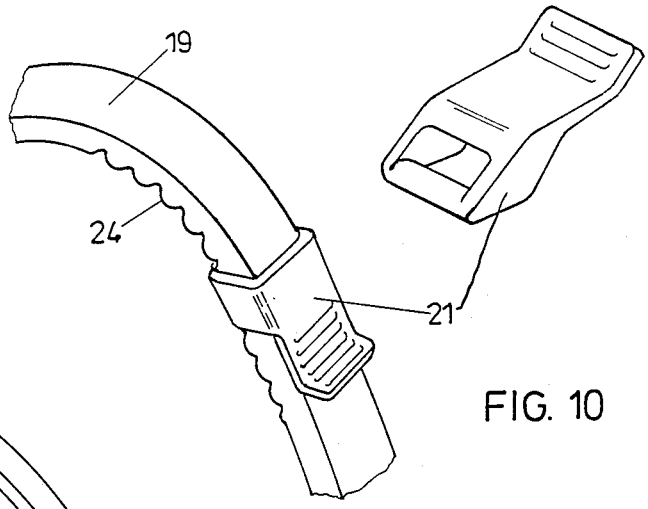
FIG. 10
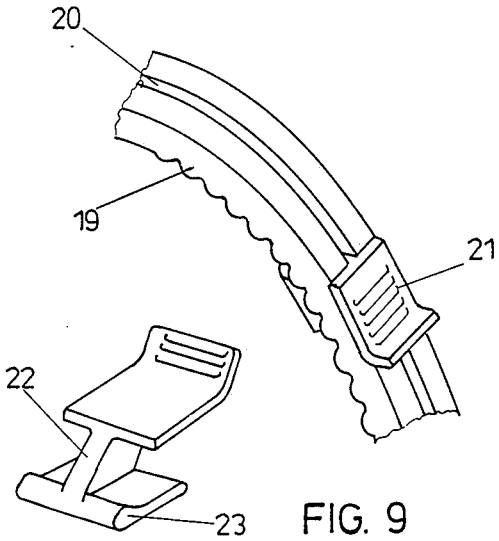
FIG. 9
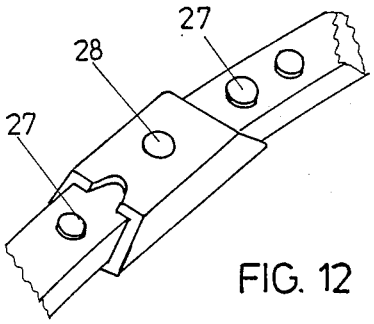
FIG. 12
FIG. 11
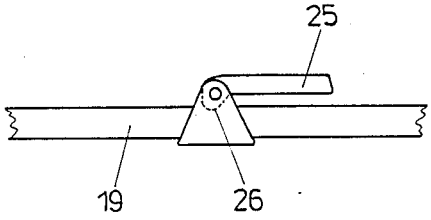

SKIING BOOT

BACKGROUND OF THE INVENTION

1. Field of the Invention

This invention relates to a skiing boot comprising a plastic base shell and a leg part or gaiter, which is pivotally movable relative to the base shell and has an end portion that faces the toe of the boot and is engageable with the base shell during a pivotal movement toward the toe of the boot.

2. Description of the Prior Art

In known skiing boots of that kind the forward edge facing the toe of the boot constitutes an engaging surface, which is adapted to cooperate with a corresponding abutment provided on the base shell during a pivotal movement toward a forward lean position. It is also known to provide damping interlayers on the engaging surface or the abutment surface or in the space between said two surfaces in order to avoid a hard impact of the pivoted leg part on the base shell.

SUMMARY OF THE INVENTION

It is an object of the invention to provide such a skiing boot which distinguishes by exhibiting an improved damping behavior during an adjustment toward a forward lean position and also to improve the seal of the boot at the joint between the base shell and the leg part. This object is substantially accomplished in accordance with the invention in that the end portion of the leg or gaiter is formed on the outside with at least one recess or groove, which extends transversely to the direction of the pivotal movement and has a bottom that is defined by an unapertured wall or by at least one web which connects the confronting side faces of the groove, and that elements having rubberlike elasticity and, if desired, rigid elements are adapted to be inserted into the recess or groove. The flexibility of the lower portion of the leg or gaiter is formed in its outside surface with a recess or groove which extends transversely to the direction of the pivotal movement. During a pivotal movement of the leg, the inside surface of the leg part or gaiter can conform more closely to the outside contour of the opposite or underlying portion of the base shell so that an improved seal is ensured throughout the pivotal movement. At the same time a progressive frictional damping is effected during a pivotal movement toward a forward lean position because the area of the contact surface between the end portion of the leg part or gaiter and the base shell will progressively increase. The provision of the recess or groove permits a simple arrangement of an insert of a material having rubberlike elasticity. Different from the known arrangement that insert need not be glued but can be held in position by much simpler means. If the leg part or gaiter were formed in its end portion with a slot, the selection of the elastomeric material would be highly restricted and the damping elements inserted into such a slot might extend through the slot. On the other hand, the accommodation of the insert in a recess or groove formed in the upper surface of the end portion of the leg part or gaiter and defined by at least one web permits the material having rubberlike elasticity to be held in the groove or recess under initial stress so that said material will be held in the groove owing to the elastic properties of the material. If the elastic material were held in an aperture which is not defined by a connecting web, the material could not be held in such aperture under initial stress because the elastic material would necessarily contact the base shell and the soft elastic material would be squeezed between the base shell and the end portion of the leg part or gaiter. Because the bottom of the groove is constituted by an unapertured wall or at least by webs connecting the two confronting side walls of the groove, the saddle surfaces will be non-congruent to some extent, so that a pivotal movement will result in a progressive damping. That measure affords also the advantage that regardless of the nature of the insert the travel performed until the engaging surface of the gaiter engages the abutment provided on the base shell will always be the same. The insert which is accommodated in the groove having a bottom defined at least by webs may also be rigid or made of metal and the use of such insert will not result in a deformation of the forward portion of the gaiter. In this manner the kinematics of the damping behavior can be influenced and the groove which is provided in accordance with the invention and has a bottom defined at least by webs permits of an adjustment merely of the stiffness whereas the extent of the travel to the limit defining the foremost forward lean position will not be altered.

It is also ensured that the lower end of the gaiter constitutes a defined, rigid and inflexible run-up edge and can closely hug the shell like a belt. In such an arrangement the webs or the unapertured bottom of the groove ensure that the forward edge of the gaiter will reliably be carried along during the rearward pivotal movement and that the damping elements remain in position throughout the pivotal movement.

When a pivotal movement of the leg part or gaiter has caused the forward edge of the leg part or gaiter to engage the base shell, the recess or groove will subsequently be compressed in such a manner that the confronting walls are pivotally moved to a position in which they converge in an outward direction. This affords the advantage that an emergence of the insert of material having rubberlike elasticity from the recess or groove will be more reliably avoided when the end portion of the leg part or gaiter is underload. The skiing boot is preferably so designed that those surfaces of the recess or groove which extend transversely to the pivotal movement include with the bottom of the recess or groove an angle which is smaller than or equal to 90°. As a result, the groove or recess has in a relaxed condition such a configuration that the material having rubberlike elasticity will be held in the accommodating groove or recess by an increasing force when a pivotal movement results in an increasing mechanical stress of the elastic material.

The insert of material having rubberlike elasticity may be positively held in the recess or groove in a simple manner so that said insert need not be glued. Adhesives would adversely affect the elastic damping and if applied to elastic inserts would not be highly durable, as a rule, and would not reliably prevent a loss, particularly in case of large fluctuations of temperature. The design in accordance with the invention eliminates the need for such adhesives but does not involve a high risk of a loss of the insert consisting of a material having rubberlike elasticity.

The elimination of an adhesive joint permits also the use of a readily replaceable insert will reliably be held in the groove or recess, the insert may desirably be held in the recess or groove under a tensile stress acting in the longitudinal direction of the insert.

The insert having rubberlike elasticity may be anchored in the recess or groove in a simple manner in that the groove is provided with a central rib, which extends along part of the length of the recess or groove and enters an elongate opening formed in the insert having rubberlike elasticity. In such an arrangement there will be two parallel regions which effect an elastic damping. In another simple arrangement the recess or groove has side edge portions which are laterally enlarged and/or are formed with elevations or depressions cooperating with mating portions of the insert. In both cases the element having rubberlike elasticity can be lifted from the bottom of the groove in a simple manner and can be replaced by an element which also has rubberlike elasticity but different damping properties. Because the element having rubberlike elasticity is initially stressed in its longitudinal direction there is no risk of an unintended emergence of the element from the recess or groove accommodating said element.

BRIEF DESCRIPTION OF THE DRAWING

FIG. 9 shows a modified insert, which consists of a plurality of rigid elements.

FIG. 10 shows a further modified embodiment which is similar to that of FIG. 9.

FIG. 11 is a side elevation showing a further modified embodiment.

FIG. 12 is a perspective elevation showing an embodiment in which the insert comprises stiff locking element.

DETAILED DESCRIPTION OF THE PREFERRED EMBODIMENTS

Figure 1:
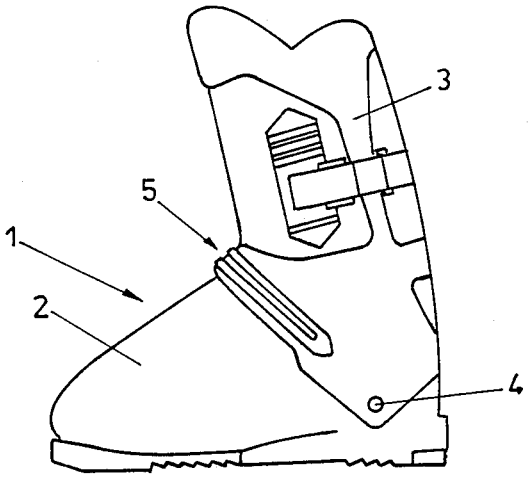
FIG. 1 is a side elevation showing a boot provided in its leg part with a first embodiment of an insert having rubberlike elasticity.

The invention will now be explained more in detail with reference to illustrative embodiments shown in the drawing.

The skiing boot 1 shown in FIG. 1 comprises a base shell 2 and a leg part 3, which is connected to the base shell for a pivotal movement about pivot means 4 defining an axis which is substantially parallel to the plane of the sole. The leg part 3 comprises a lower end portion 5, which is provided with a peripherally extending element having rubberlike elasticity. That element will be described more in detail hereinafter with reference to FIGS. 3, 4 and 5.

Figure 2:
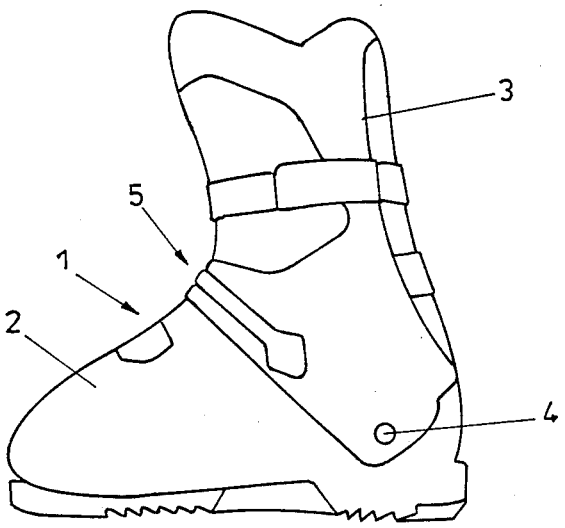
FIG. 2 is a view that is similar to FIG. 2 and shows a modification.
Figure 6:
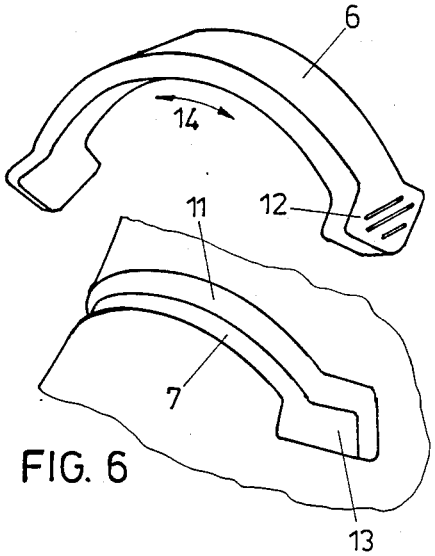
FIG. 6 shows a modified element of rubberlike elasticity for use in the embodiment of FIG. 2 together with the associated groove.

In the embodiment shown in FIG. 2 the element which has rubberlike elasticity and is accommodated in the forward end portion 5 of the gaiter is designed as shown in FIG. 6. That element will be described in detail hereinafter with reference to FIG. 6.

Figure 3:
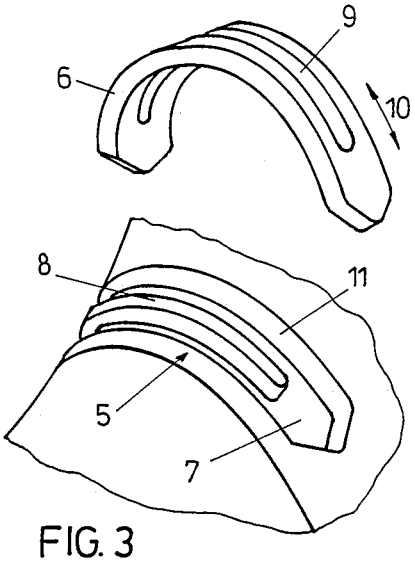
FIG. 3 shows the element having rubberlike elasticity and used in the embodiment of FIG. 1 and the groove which accommodates said element.

FIG. 3 shows an element 6 which has rubberlike elasticity and is inserted into a groove or recess 7 formed in the end portion 5 of a gaiter. That groove is provided with a central rib 8, which extends into a slot 9 formed in the insert 6 of material which has rubberlike elasticity. The insert 6 of material which has rubberlike elasticity is tensioned in the direction indicated by the doubleheaded arrow 10 as it is inserted into the groove 7 and caused to receive the rib 8.

Figure 4:
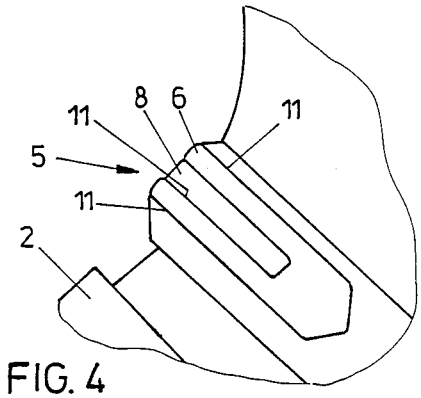
FIG. 4 is a side elevation showing on a larger scale the boot provided with the inserted element in a related state.
Figure 5:
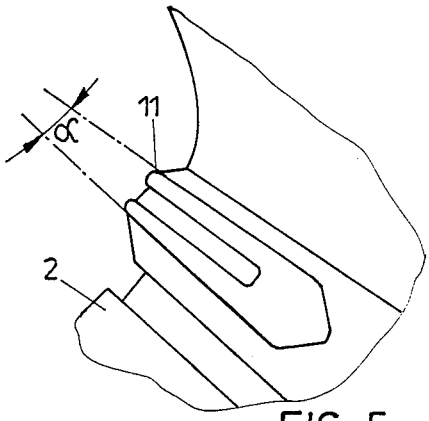
FIG. 5 is a view that is similar to FIG. 4 and shows the element in a compressed state.

As is apparent from FIG. 4 the inside surfaces 11 of the groove 7 are substantially parallel so that they intersect with the bottom of the groove an angle which is smaller than or equal to 90°. During a pivotal movement toward the toe, the leg part 3 will be compressed as shown in FIG. 5 and the inside surface of the gaiter will run up on the base shell 2 and the groove will be deformed to a shape in which the surfaces 11 converge at an angle $\alpha$. That convergence of the surfaces 11 will prevent an unintended emergence of the elastomeric insert from the groove when the elastic element 6 is mechanically stressed.

The embodiment shown in FIG. 6 is intended for use in a boot as shown in FIG. 2 and the insert 6 of material having rubberlike elasticity is formed with laterally enlarged head portions 12, which can be inserted into corresponding enlarged end portions 13 of the groove 7. That insert 6 of material having rubberlike elasticity may also be elastically tensioned in the peripheral direction indicated by the double-headed arrow 14 as the insert is inserted into the groove 7 so that the insert in the groove will be subjected to a component of force acting toward the bottom of the groove. The side faces 11 of the groove 7 are designed like those shown in FIGS. 1, 3, 4 and 5.

Figure 7:
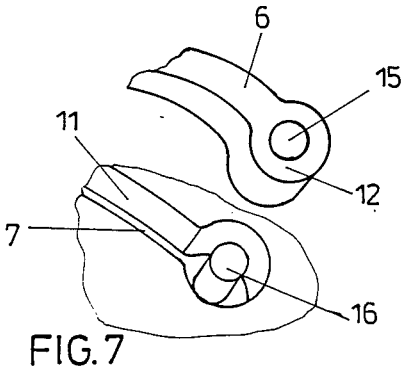
FIG. 7 shows another modified embodiment of an element having rubberlike elasticity together with the associated groove.
Figure 8:
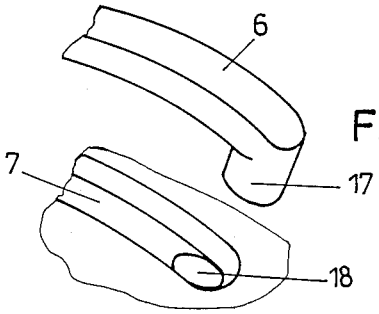
FIG. 8 shows a further modified embodiment of the element having rubberlike elasticity together with a portion of the associated groove.

In the embodiment shown in FIG. 7 the enlarged head portion 12 of the insert 6 made of a material having rubberlike elasticity is formed with a recess 15, which can be fitted on a pin 16 projecting from the bottom of the enlarged portion 13 of the groove 7. In the embodiment shown in FIG. 8 the insert 6 is formed with a substantially cylindrical, hook-shaped end portion 17, which is adapted to be forced into a mating recess 18 formed in the bottom of the groove 7. All said embodiments ensure that the element having rubberlike elasticity will not unintendedly emerge from the groove and there is no need for an adhesive joint.

The insert 19 having rubberlike elasticity which is shown in FIG. 9 is formed in its central portion with a slot 20, in which a slider consisting of rigid material, such as plastic or metal, is slidably guided. The outside surface of that slider is designated 21. The slider has a central web 22, which extends through the slot formed in the insert. A base portion 23 of the slider is supported on the bottom of the groove.

In the embodiment shown in FIG. 10 the slider 21 consists of a member which surrounds an elastic insert and which is held in position by fitting around transverse ribs 24 formed on the underside of the elastic insert 19. As is shown in FIG. 11 such rigid elements can be fixed to a flexible insert, e.g., by means of an eccentric lever 25, which has an eccentrically disposed nose 26 and can squeeze the latter against the outside surface of the insert 19 having rubberlike elasticity. The insert may also be fixed by means of interengaging parts, as is shown in FIG. 12, where the elastic insert is formed with knobs 27, which can be fitted into an aperture 28 formed in a slidable rigid member in order to hold the insert in position.

What is claimed:

1. A skiing boot comprising a plastic base shell and a gaiter pivotally secured to the base shell, said gaiter having an end portion which faces a toe portion of the base shell and which engages the base shell during pivotal movement of the gaiter towards said toe portion; a recess formed on an exterior surface of said end portion of the gaiter, said recess extending transversely to the direction of pivotal movement of the gaiter; and a compressible insert disposed within said recess.

2. A skiing boot according to claim 1, wherein said recess defines a pair of walls which extend transversely to the direction of pivotal movement of the gaiter, each of said walls intersecting a bottom of the recess to define an angle within the recess which does not exceed 90°.

3. A skiing boot according to claim 1, further comprising: means provided within said recess for imposing tensile stress on the insert transversely to the direction of pivotal movement of the gaiter.

4. A skiing boot according to claims 1 or 3, further comprising a rib provided within the recess and extending transversely to the direction of pivotal movement of the gaiter, said rib extending within a slot formed in said insert.

5. A skiing boot according to claims 1 or 3, wherein said recess is enlarged at at least one if its ends to receive an enlarged end portion of said insert.

6. A skiing boot according to claims 1 or 3, wherein said recess is provided at at least one of its ends with a projection which extends within an aperture formed in an end portion of said insert.

7. A skiing boot according to claims 1 or 3, wherein said recess is provided at at least one of its ends with a depression which receives a projection formed in an end portion of said insert.

* * * * *